US007866050B2

(12) United States Patent
Yu

(10) Patent No.: US 7,866,050 B2
(45) Date of Patent: Jan. 11, 2011

(54) HANDHELD TOOL STRUCTURE

(76) Inventor: Shu-Feng Yu, 11F., No. 14, Lane 71, Ande St., Sindian City, Taipei County (TW)

( * ) Notice: Subject to any disclaimer, the term of this patent is extended or adjusted under 35 U.S.C. 154(b) by 440 days.

(21) Appl. No.: 12/153,547

(22) Filed: May 21, 2008

(65) Prior Publication Data

US 2009/0288527 A1 Nov. 26, 2009

(51) Int. Cl.
*B25G 3/00* (2006.01)

(52) U.S. Cl. ..... 30/343; 30/322; 30/324; 30/342; 279/105

(58) Field of Classification Search ..... 30/340, 30/342, 322, 324, 343; D22/118; 279/105, 279/104, 93
See application file for complete search history.

(56) References Cited

U.S. PATENT DOCUMENTS

| | | | | | |
|---|---|---|---|---|---|
| 624,380 | A * | 5/1899 | Rising | 279/105 |
| 803,161 | A * | 10/1905 | Hastings | 279/105 |
| 1,030,321 | A * | 6/1912 | Muller | 76/104.1 |
| 1,118,360 | A * | 11/1914 | Lange | 279/105 |
| 1,806,244 | A * | 5/1931 | Echikson | 30/343 |
| 1,988,807 | A * | 1/1935 | Pierson | 30/164.5 |
| 2,072,581 | A * | 3/1937 | Curtis | 30/343 |
| 2,615,247 | A * | 10/1952 | Waters | 30/342 |
| 2,759,263 | A * | 8/1956 | Shigley et al. | 30/317 |
| 2,762,120 | A * | 9/1956 | Mack | 30/1 |
| 3,191,460 | A * | 6/1965 | Christian et al. | 76/104.1 |
| 3,742,602 | A * | 7/1973 | Brumwell | 30/340 |
| 3,853,495 | A * | 12/1974 | Shire | 29/460 |
| 5,008,970 | A * | 4/1991 | Tsai | 15/236.01 |
| 5,832,615 | A * | 11/1998 | Costen et al. | 30/517 |
| 5,934,905 | A * | 8/1999 | Martoral et al. | 433/144 |
| 6,408,524 | B1 * | 6/2002 | Lai | 30/324 |
| 6,497,046 | B1 * | 12/2002 | Bardeen et al. | 30/517 |
| 6,675,483 | B2 * | 1/2004 | Bond et al. | 30/142 |
| 2004/0064956 | A1 * | 4/2004 | Tsai | 30/342 |
| 2009/0019709 | A1 * | 1/2009 | Fisher et al. | 30/344 |

* cited by examiner

*Primary Examiner*—Kenneth E. Peterson
*Assistant Examiner*—Sean Michalski
(74) *Attorney, Agent, or Firm*—Bacon & Thomas, PLLC

(57) ABSTRACT

A handheld tool structure includes a tool member, a handle, a cover and a connecting peg. The handle is barrel-shaped and has an opening at an end of the handle. An end of the tool member is slab-shaped and the tool member has at least one penetrating hole and at least one notch. An end of the connecting peg has a slender groove, and the top of the cover has a slender slot. An end of the tool member is passed through the slot of the cover and inserted into the groove of the connecting peg, and the cover and the connecting peg are connected, and another end of the connecting peg is plugged into the handle from an opening at an end of the handle, and the cover is plugged into the handle until the top of the cover is aligned evenly with a distal surface of the handle.

5 Claims, 6 Drawing Sheets

HANDHELD TOOL STRUCTURE

FIELD OF THE INVENTION

The present invention relates to a handheld tool structure, and more particularly to a handheld tool structure that provides shock absorbing and vibration suppressing effects for preventing the connection of each component of the handheld tool from being loosened.

BACKGROUND OF THE INVENTION

Referring to FIG. 1 for a traditional handheld tool 1, the handheld tool 1 is a piece of dining ware or kitchen ware including a tool member 10, a handle 11 and a cover 12, all made of metal. The handle 11 is substantially barrel-shaped and has an opening 110 disposed at an end of the handle 11, and the cover 12 is substantially circular-disc shaped and embedded into the opening 110 of the handle 11, and the top of the cover 12 has a slender slot 121. An end of the tool member 10 is substantially slab-shaped, and a notch 101 is disposed separately on both lateral edges. During a manufacture process of assembling components of the handheld tool 1, an end of the tool member 10 is usually passed through the slot 121 of the cover 12, and an abutting surface 102 formed by the notch 101 abuts the top of the cover 12, and the cover 12 is embedded into the opening 110 of the handle 11, and the top of the cover 12 is aligned evenly with a distal surface of the handle 11. Further, an end of the tool member 10 proximate to both lateral edges 103 of the notch 101 is abutted with an internal wall of the handle 11. Since the lateral edge 103 and the internal wall of the handle 11 are coupled with each other in a packing way, and the cover 12 and the handle 12 are also coupled with each other in a packing way, therefore the assembled components including the tool member 10, the cover 12 and the handle 11 can be integrated securely.

In a normal operation, the components of the handheld tool 1 will not be loosened or fallen out easily. However, if a user operates the handheld tool 1 and drops the handheld tool 1, and the handheld tool 1 hits the floor or the user bangs the handheld tool 1 on a hard object inappropriately, the components of the handheld tool 1 will be deformed since the components are rigid structures made of a metal material and integrated in the packing way and there is no shock absorbing structure between the components. The integration of components in the packing way will be destroyed, and the components will be loosened or even fallen apart, if the handheld tool 1 is dropped on the floor or banged on a hard object. Unfortunately, it is inevitable for users to drop the handheld tool 1 on a floor or use the handheld tool to bang on a hard object once in a while. There is a potential risk of having loosened components of the handheld tool 1 after the handheld tool 1 has been used for a long time. Since the length of the slot 121 at the top of the cover 12 is smaller than the diameter of the opening 110 at an end of the handle, and the width between both lateral edges 103 of the tool member 10 is slightly greater than the diameter of the opening 110 and also greater than the length of the slot 121, the tool member 10 cannot be inserted into the slot 121 along the same axial direction of the cover 12 and the handle 11 during the assembling process. It is necessary to turn the tool member 10 to an angle before the tool member 10 can be inserted into the slot 121. Obviously, such turning procedure causes an unsmooth operation unfavorable for the automated assembling process.

Therefore, it is an important subject for designers and manufacturers to design and develop a handheld tool, such that the handheld tool can be assembled automatically and easily, and each component can be integrated with the handheld tool securely.

SUMMARY OF THE INVENTION

In view of the shortcomings of the traditional handheld tool whose components may be loosened easily and whose assembly is unfavorable to the automated manufacture, the inventor of the present invention based on years of experience in the related industry to conduct extensive researches and experiments, and finally invented a handheld tool structure and a method of manufacturing the handheld tool.

It is a primary objective of the present invention to provide a handheld tool structure, and the handheld tool is a dining ware or kitchen ware with a handle, and the handheld tool comprises a tool member, a handle and a cover, all made of a metal material (such as stainless steel) and a connecting peg made of a thermoplastic material (such as plastic and synthetic rubber). The thermoplastic material features a high plasticity when heated to a certain temperature, and resumes a solid shape when cooled to room temperature. The handle is substantially barrel-shaped, and has an opening disposed at an end of the handle, and an end of the tool member is substantially slab-shaped and has at least one penetrating hole disposed at an end of the tool member and at least one notch disposed on the tool member and proximate to both lateral edges of the penetrating hole. An end of the connecting peg has a slender groove, and the top of the cover has a slender slot. During a manufacture process for assembling components of the handheld tool, an end of the tool member is passed through the slot of the cover and inserted into the groove of the connecting peg, and the cover and the connecting peg are connected, and another end of the connecting peg is plugged into the handle from an opening at an end of the handle, and the cover is also plugged into the handle until the top of the cover is aligned evenly with a distal surface of the handle, so that the connecting peg and the cover are installed together into the handle in a packing way.

Another objective of the present invention is to provide a handheld tool structure comprising a tool member with a substantially slab-shaped end and an insert portion with a width smaller than the tool member. The insert portion has the penetrating hole thereon and the notch disposed proximate to both lateral edges of the penetrating hole. Further, the width of the insert portion is smaller than the length of the slot, so that the insert portion can be passed through the slot and inserted into the groove until an abutting surface formed by both lateral sides of the tool member abuts the top of the cover, so as to couple the tool member, the cover and the connecting peg. Since the length of the slot is slightly greater than the width of the insert portion, the insert portion can be passed into the slot along the same axial direction of the cover and the handle and inserted into the groove. The invention can make the assembling process smooth and facilitate the automated manufacture.

A further objective of the present invention is to provide a handheld tool structure for securing the connection of components, the connecting peg includes a packing structure disposed on an external side of the connecting peg, and the packing structure is composed of a plurality of protrusions (such as a plurality of protruding dots or ribs) for connecting the handle closely. After the handheld tool is assembled, a portion of the handle corresponding to the connecting peg is heated, such that the contact positions of the connecting peg with other components are heated and deformed, and a portion of material of the connecting peg is squeezed into each notch and each penetrating hole. After cooling, the heated and deformed connecting peg is shaped to integrate the components securely. Further, the connecting peg is softer than other components and has a shock absorbing effect, so that when the handheld tool is hit or banged, the connecting peg provides shock absorbing and vibration suppressing effects, and the connection of components can be secured.

To make it easier for our examiner to understand the shape, structure, design principle and performance of the present invention, we use preferred embodiments together with the attached drawings for the detailed description of the invention as follows.

DETAILED DESCRIPTION OF THE PREFERRED EMBODIMENTS

Figure 1:
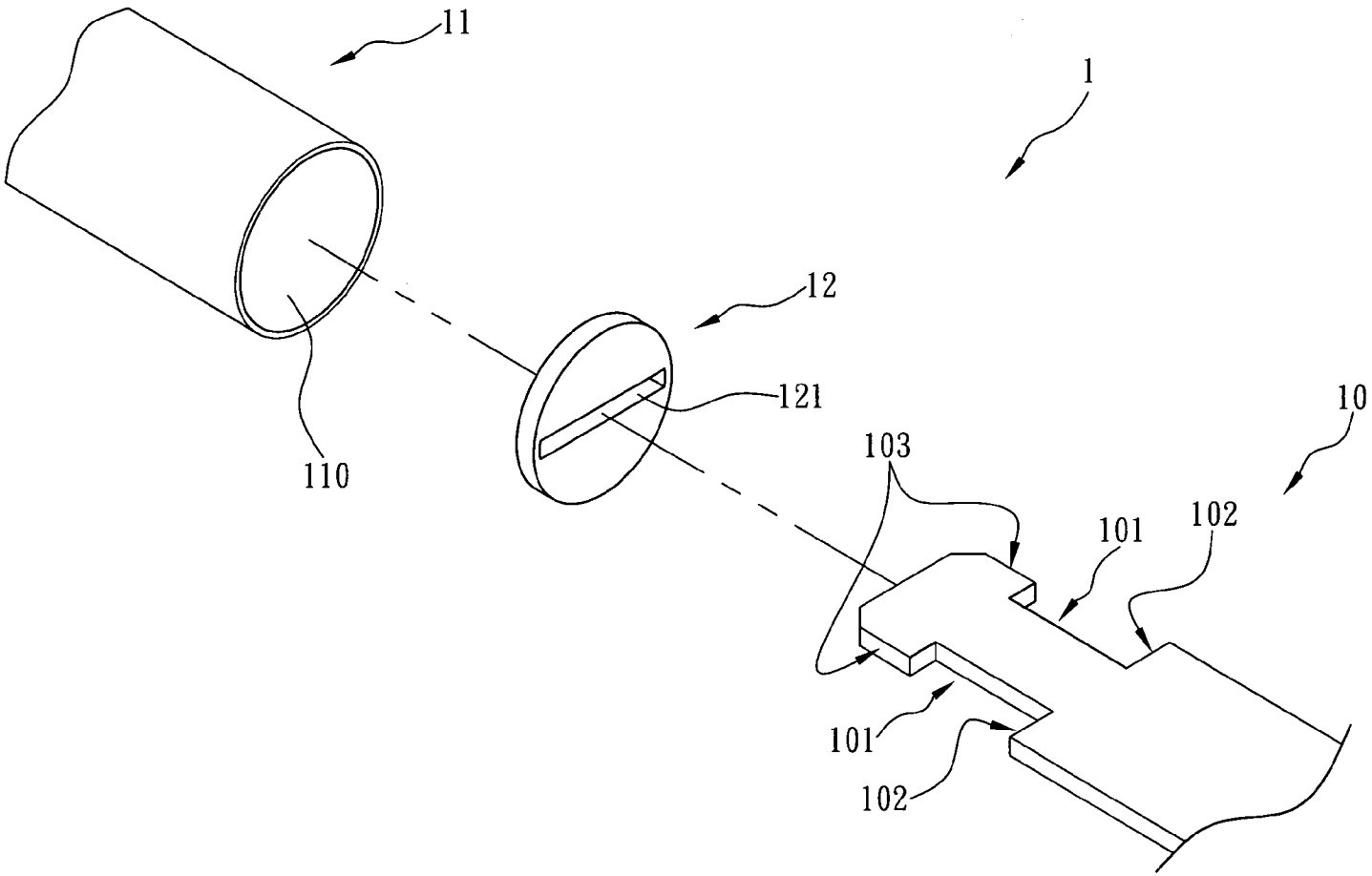
FIG. 1 (Prior Art)
FIG. 1 is an exploded view of a traditional handheld tool.
Figure 2:
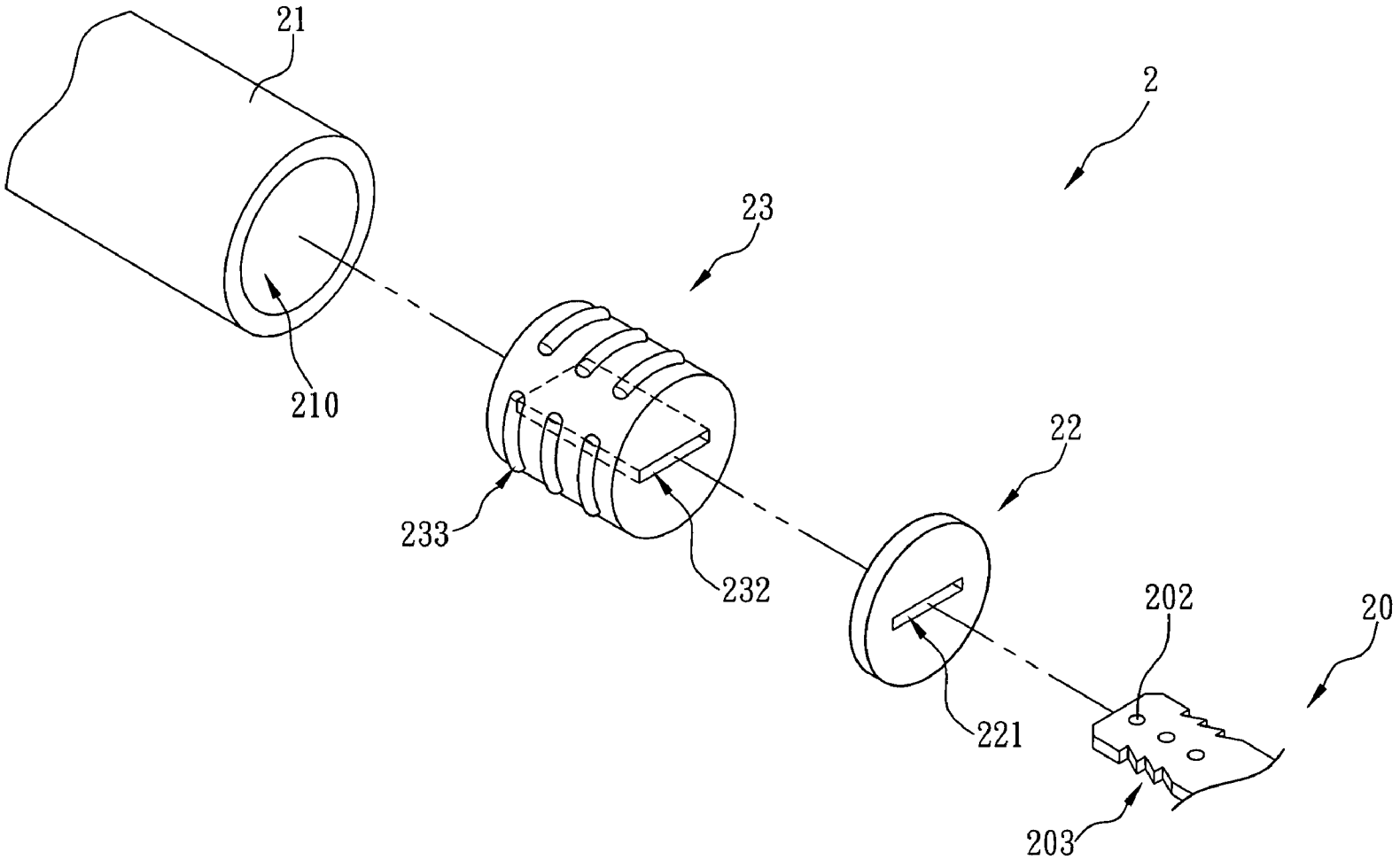
FIG. 2 is an exploded view of a handheld tool in accordance with a first preferred embodiment of the present invention.

Referring to FIG. 2 for an exploded view of a handheld tool in accordance with a first preferred embodiment of the present invention, the handheld tool 2 comprises a tool member 20, a handle 21, and a cover 22, all made of a metal material and a connecting peg 23 made of a synthetic rubber material. The handle 21 is substantially barrel-shaped and has an opening 210 disposed at an end handle 21. An end of the tool member 20 is substantially slab-shaped, and a plurality of penetrating holes 202 are disposed on the tool member 20, and a plurality of notches 203 are disposed on both lateral edges of the tool member 20 and proximate to the penetrating holes 202. A slender groove 232 is disposed at an end of the connecting peg 23, and a slender slot 221 is disposed at the top of the cover 22. An end of the tool member 20 is passed into the slot 221 and inserted into the groove 232 for coupling the tool member 20, the cover 22 and the connecting peg 23. Another end of the connecting peg 23 is plugged into the handle 21 from the opening 210 of the handle 21, and the cover 22 is also plugged into the handle 21, so that the connecting peg 23 and the cover 22 are installed into the handle 21 in a packing way, and the top of the cover 22 is aligned evenly with an end of the handle 21.

In the first preferred embodiment of the invention as shown in FIG. 2, an external surface of the connecting peg 23 has a packing structure 233 for securing the connecting peg 23 with the handle 31; and after the handheld tool 2 is assembled, a position of the handle 21 corresponding to the connecting peg 23 is heated to deform the contact positions of the connecting peg 23 with the handle 21, and the tool member 20 with the cover 22, so that a portion of the synthetic rubber material is deformed and squeezed into each notch 203 and penetrating hole 202 of the tool member. When cooled to room temperature, the heated and deformed portion of the connecting peg 23 is shaped, and each component is integrated securely. Since the connecting peg 23 is made of a synthetic rubber material, the connecting peg 23 has the effect of absorbing vibrations. When the handheld tool 2 is hit or collided, the connecting peg 23 provides the shock absorbing and vibration suppressing effects for preventing the connection of each component from being loosened.

Figure 3:
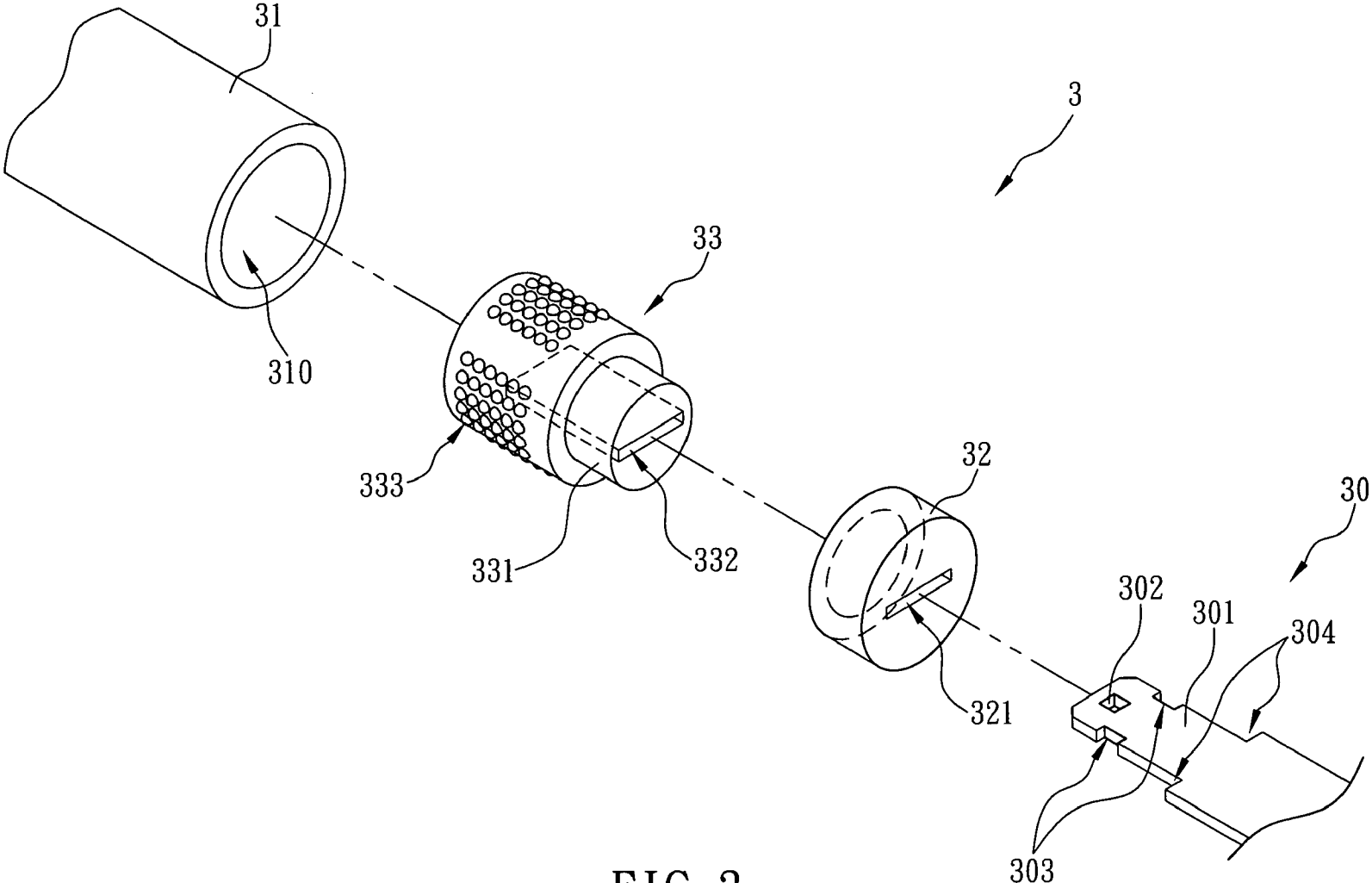
FIG. 3 is an exploded view of a handheld tool in accordance with a second preferred embodiment of the present invention.

Referring to FIG. 3 for an exploded view of a handheld tool in accordance with a second preferred embodiment of the present invention, the handheld tool 3 comprises a tool member 30, a handle 31, and a cover 32 made of a metal material and a connecting peg 33 made of a plastic material. The handle 31 is substantially barrel-shaped and has an opening 310 disposed at an end of the handle 31. An end of the tool member 30 is substantially slab-shaped, and has an insert portion 301 with a width smaller than the width of the tool member 30, so that an abutting surface 304 is formed by both lateral sides of the tool member 30. The insert portion 301 has a penetrating hole 302, and a notch 303 disposed proximate to both lateral edges of the penetrating hole 302. A connecting portion 331 is protruded from an end of the connecting peg 33 and sheathed to the cover 32, and a slender groove 332 is disposed at a distal surface of the connecting portion 331, and a slender slot 321 is disposed at the top of the cover 32, wherein the length of the slot 321 is slightly greater than the width of the insert portion 301, so that the insert portion 301 can be passed through the slot 321 and inserted into the groove 332 until the abutting surfaces 304 on both lateral sides of the tool member 30 abut against the top of the cover 32, and the tool member 30 is coupled to the cover 32 and the connecting peg 33. Further, another end of the connecting peg 33 is plugged into the handle 31 from the opening 310 of the handle 31, and the cover 32 is plugged into the handle 31 at the same time, such that the connecting peg 33 and the cover 32 are installed in the handle 31 in a packing way, and the top of the cover 32 is aligned evenly with an end of the handle 31. Since the length of the slot 321 is greater than the width of the insert portion 301, the insert portion 301 can be passed through the slot 321 along the same axial direction and inserted into the groove 332, so that the assembling flow will be very simple, easy and smooth to facilitate the automated assembling process.

Figure 4:
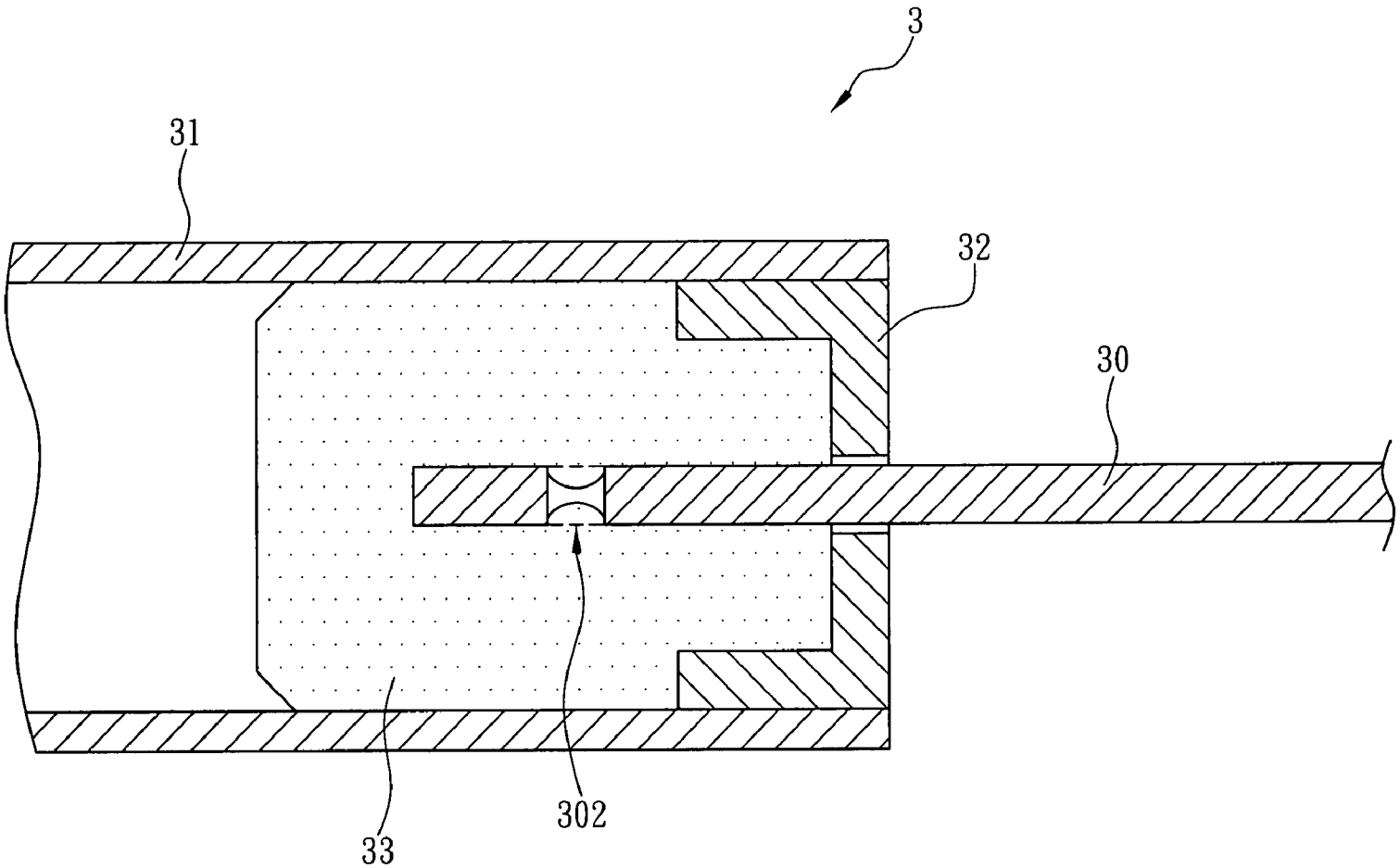
FIG. 4 is a cross-sectional view of a handheld tool in accordance with a second preferred embodiment of the present invention.

In the second preferred embodiment of the present invention as shown in FIG. 3, the connecting peg 33 includes a packing structure 333 disposed on an external side of the connecting peg 33, and the packing structure 333 is composed of a plurality of protruding dots for connecting the packing structure 333 and the connecting peg 33 with the handle 31 more closely. After the handheld tool 3 is assembled, the position of the handle 31 corresponding to the connecting peg 33 is heated, so that the contact positions between the connecting peg 33 and the handle 31 as well as the tool member 30 and the cover 32 are heated and deformed, and a portion of the plastic material is squeezed into each notch 303 and each penetrating hole 302 of the tool member as shown in FIG. 4. After cooling to the room temperature, the heated and deformed portion of the connecting peg 33 is shaped, and the components are integrated securely with each other as a whole. Since the connecting peg 33 is made of a plastic material with a shock absorbing effect, the connecting peg 33 provides shock absorbing and vibration suppressing effects for securing the components in their positions when the handheld tool 3 is hit.

Figure 5:
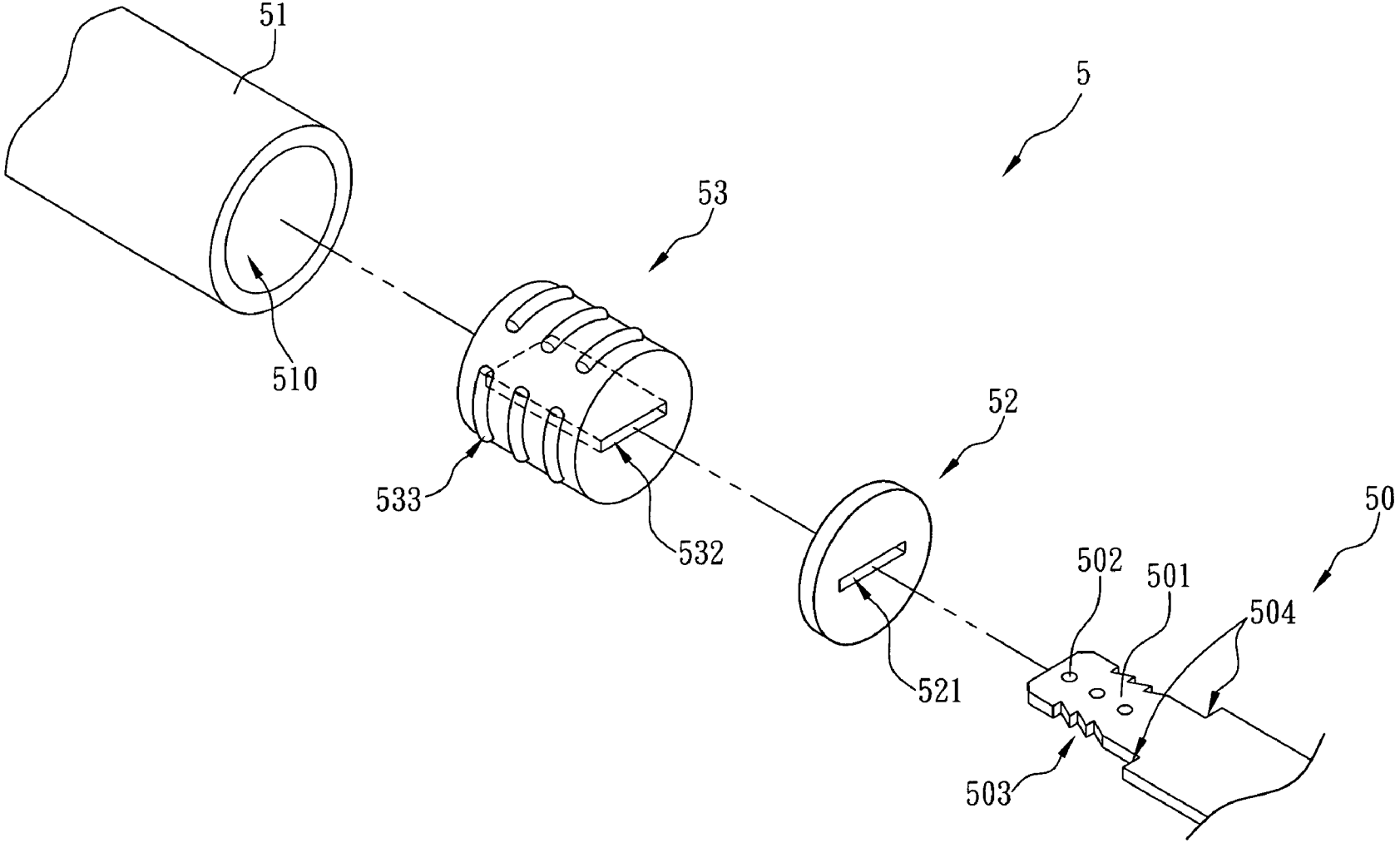
FIG. 5 is an exploded view of a handheld tool in accordance with a third preferred embodiment of the present invention.

Referring to FIG. 5 for an exploded view of a handheld tool in accordance with a third preferred embodiment of the present invention, the handheld tool 5 comprises a tool member 50, a handle 51, and a cover 52, all made of a metal material and a connecting peg 53 made of a synthetic rubber material. The handle 51 is substantially barrel-shaped and includes an opening 510 disposed at an end of the handle 51, and an end of the tool member 50 is substantially slab-shaped, and includes an insert portion 501 with a width smaller than the width of the tool member 50 so that an abutting surface 504 is formed separately on both lateral sides of the tool member 50, and the insert portion 501 includes a plurality of penetrating holes 502, and a plurality of notches 503 disposed proximate to both lateral edges of the penetrating hole 502. An end of the connecting peg 53 has a slender groove 532, and the cover 52 is substantially slab-shaped, and the top of the cover 52 has a slender slot 521, and the length of the slot 521 is slightly greater than the insert portion 501, so that the insert portion 501 can be passed through the slot 521 and inserted into the groove 532 until the abutting surfaces 504 on both lateral sides of the tool member 50 abut against the top of the cover 52 for coupling the tool member 50 with the cover 52 and the connecting peg 53. Another end of the connecting peg 53 is plugged into the handle through the opening 510 of the handle 51, and the cover 52 is plugged into the handle 51 at the same time, so that the connecting peg 53 and the cover 52 are installed into the handle 51 in a packing way, and the top of the cover 52 is aligned evenly with an end of the handle 51.

Figure 6:
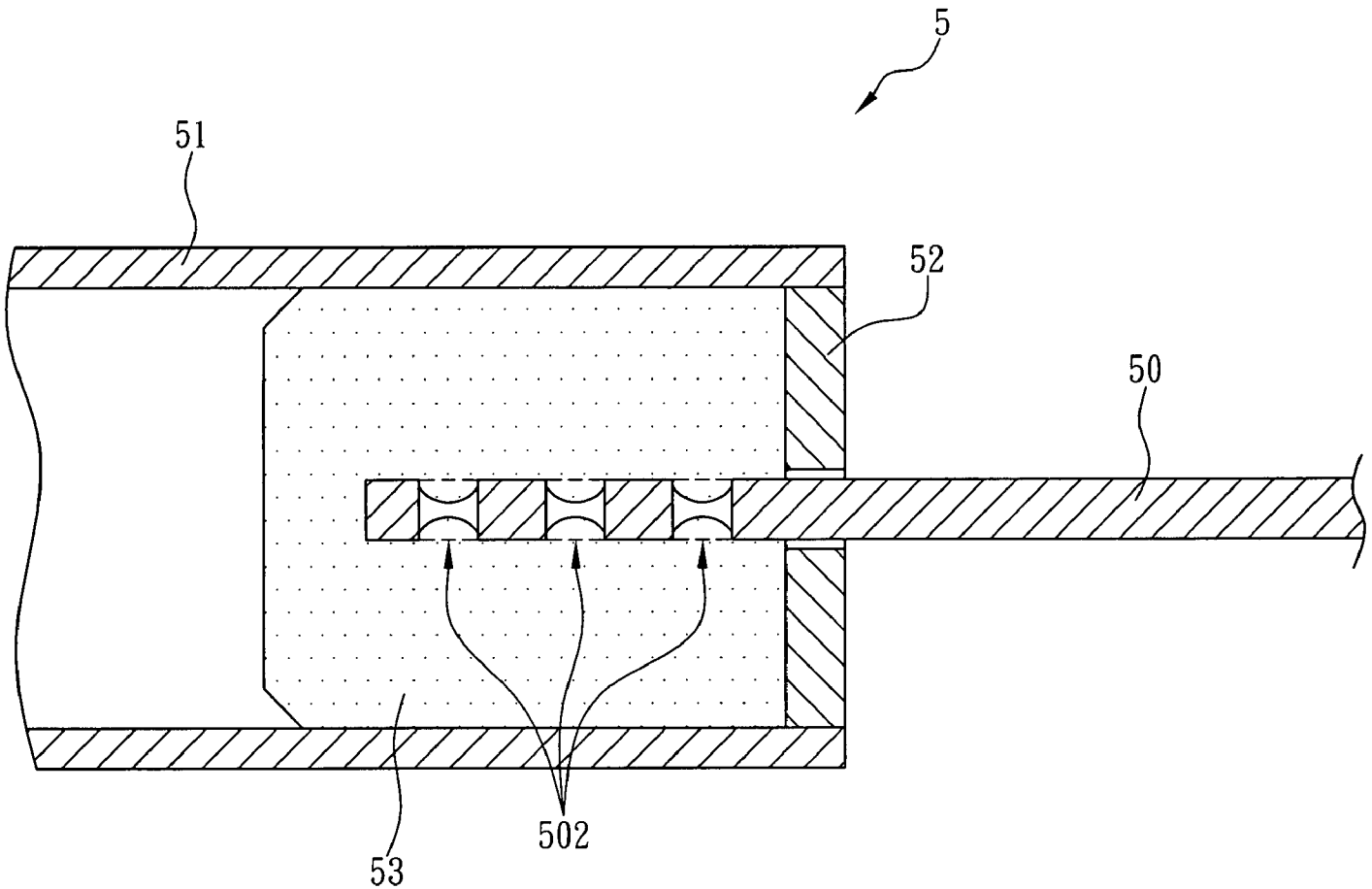
FIG. 6 is a cross-sectional view of a handheld tool in accordance with a third preferred embodiment of the present invention.

In the third preferred embodiment of the present invention as shown in FIG. 5, the connecting peg 53 includes a packing structure 533 disposed on an external side of the connecting peg 53, and the packing structure 533 is composed of a plurality of ribs, so that the packing structure and the connecting peg 53 can be connected with the handle 51 more closely. After the handheld tool 5 is assembled, a portion of the handle 51 corresponding to the connecting peg 53 is heated, such that contact positions of the connecting peg 53 and the handle 51, as well as the tool member 50 and the cover 52 are heated and deformed, and a portion of synthetic rubber material is squeezed into each notch 503 and each penetrating hole 502 of the tool member as shown in FIG. 6. After cooling to room temperature, the heated and deformed portion of the connecting peg 53 is shaped for integrating each component more securely. Since the connecting peg 53 made of a synthetic rubber material has a shock absorbing effect, when the handheld tool 5 is hit or banged, the connecting peg 53 can achieve the shock absorbing and vibration suppressing effects for securing the connecting positions of components. Since the length of the slot 521 is greater than the width of the insert portion 501, the insert portion 501 can be passed through the slot 521 along the same axis and inserted into the groove 532, and the invention can provide a simple, easy and smooth procedure to facilitate an automated assembling.

The present invention has been described with the preferred embodiment thereof and it is understood that many changes and modifications to the described embodiment can be carried out without departing from the scope and the spirit of the invention that is intended to be limited only by the appended claims.

What is claimed is:

1. A handheld tool structure, comprising:

a tool member, made of a metal material, and having a substantially slab-shaped end, at least one penetrating hole, and at least one notch disposed proximate to both lateral edges of the penetrating hole;

a handle, substantially barrel-shaped, and made of a metal material, and having an opening disposed at an end of the handle;

a connecting peg, made of a thermoplastic material, and the thermoplastic material having a high plasticity when heated to a specific temperature and resuming a fixed solid shape when cooled to room temperature, and the connecting peg having a slender groove disposed at an end of the connecting peg; and a cover, having a slender slot disposed at the top of the cover;

such that an end of the tool member is passed through the slot, and inserted into the groove, and coupled with the cover and the connecting peg, and another end of the connecting peg is plugged into the handle from an opening at an end of the handle, and the cover is plugged into the handle for installing the connecting peg and the cover together into the handle in a packing way, and the top of the cover is aligned evenly with a distal surface of the handle, and when the handheld tool is assembled, a portion of the handle corresponding to the connecting peg is heated, such that contact positions of the connecting peg with the handle and the tool member with the cover are deformed to allow a portion of the connecting peg to be squeezed partially into each notch and each penetrating hole of the tool member, and the heated and deformed portion of the connecting peg is shaped when cooled.

2. The handheld tool structure of claim 1, wherein the connecting peg includes a packing structure on an external side of the connecting peg, and the packing structure has a plurality of protrusions, and the connecting peg is coupled securely with the handle by the packing structure.

3. The handheld tool structure of claim 2, wherein the tool member comes with a substantially slab-shaped end and has an insert portion with a width smaller than the width of the tool member, so that an abutting surface is formed by both lateral sides of the tool member, and the insert portion has the penetrating hole thereon, and the notch is disposed separately on both lateral edges of the penetrating hole, and the width of the insert portion is smaller than the length of the slot.

4. The handheld tool structure of claim 3, wherein the connecting peg includes a connecting portion protruded from an end of the connecting peg and sheathed to the cover, and the connecting portion includes the groove disposed on a distal surface of the connecting portion, such that the insert portion can be passed through the slot and inserted into the groove until the abutting surface of the tool member abuts against the top of the cover, and the tool member is coupled with the cover and the connecting peg, and another end of the connecting peg is plugged into the handle from the opening of the handle, and the cover is plugged into the handle at the same time, such that the connecting peg and the cover are installed into the handle in a packing way, and the top of the cover is aligned evenly with a distal surface of the handle.

5. The handheld tool structure of claim 3, wherein the cover is substantially slab-shaped and includes the slot disposed at the top of the cover, so that the insert portion can be passed through the slot and inserted into the groove, until the abutting surface of the tool member abuts against the top of the cover, and the tool member is coupled to the cover and the connecting peg, and another end of the connecting peg is plugged into the handle from the opening of the handle, and the cover is plugged into the handle at the same time, such that the connecting peg and the cover are installed into the handle in a packing way, and the top of the cover is aligned evenly with a distal surface of the handle.

* * * * *